United States Patent [19]

Motzer

[11] Patent Number: 4,903,729

[45] Date of Patent: Feb. 27, 1990

[54] SAFETY VALVE

[75] Inventor: Helmut Motzer, Leinfelden-Echterdingen, Fed. Rep. of Germany

[73] Assignee: Herion-Werke KG, Fellbach, Fed. Rep. of Germany

[21] Appl. No.: 344,354

[22] Filed: Apr. 26, 1989

[30] Foreign Application Priority Data

May 19, 1988 [DE] Fed. Rep. of Germany ..... 3817123

[51] Int. Cl.[4] ..... F15B 13/043

[52] U.S. Cl. ..... 137/596.16; 91/424; 137/596.18

[58] Field of Search ..... 91/424; 137/596.16, 137/596.18

[56] References Cited

U.S. PATENT DOCUMENTS 4,473,095 9/1984 Motzer ..... 137/596.16

*Primary Examiner*—Gerald A. Michalsky

*Attorney, Agent, or Firm*—Henry M. Feiereisen

[57] ABSTRACT

A hydraulic safety valve which is controlled by two electromagnetically actuatable pilot valves is provided with two valve bodies movable in opposite direction towards each other and including control pistons for regulating the connection between one pump port, two working ports and two tank ports. Upon occurrence of a faulty switching, the valve bodies move into a hydraulically locked end position. One of both pilot valves is designed as a proportional pressure differential valve and the control pistons associated therewith are provided with fine control notches so that the valve can be proportionally controlled to thereby allow a control of the pressure buildup, the speed and direction of motion of a consumer which is connected to the valve.

7 Claims, 5 Drawing Sheets

SAFETY VALVE

BACKGROUND OF THE INVENTION

The invention refers to a hydraulically actuatable safety valve with a valve housing accommodating two valve bodies movable in opposite direction towards each other within a bore of the housing, two e.g. electromagnetically actuatable pilot valves, and inlet port for connection to a pump, two working ports and two outlet ports for connection to a tank, with each valve body having a working piston which is acted upon by the pressure fluid via control channels and the pilot valves and having control pistons connected to the working piston and regulating the connections between the pump port , the working ports and the tank ports wherein upon occurrence of a faulty switching, the pump port is connected with the working port and the other working port is connected with one of the tank ports.

Safety valves of the above-mentioned type are for example used to control the brake and the clutch of a mechanical press. For safety reasons, such a valve includes two directional control valves so that the braking action is ensured even upon failure of one valve.

SUMMARY OF THE INVENTION

The invention is based on the object to provide an improved safety valve of the above type by which the pressure buildup, speed and direction of motion of a consumer which is connected to the valve is controllable.

This object and others which will become apparent hereinafter are attained in accordance with the present invention by designing one of the pilot valves as proportional pressure differential valve and to provide the control pistons associated to the proportional pressure differential valve with fine control notches.

BRIEF DESCRIPTION OF THE DRAWING

The above and other objects, features and advantages of the present invention will now be described in more detail with reference to the accompanying drawing in which.

DETAILED DESCRIPTION OF A PREFERRED EMBODIMENT

Figure 1:
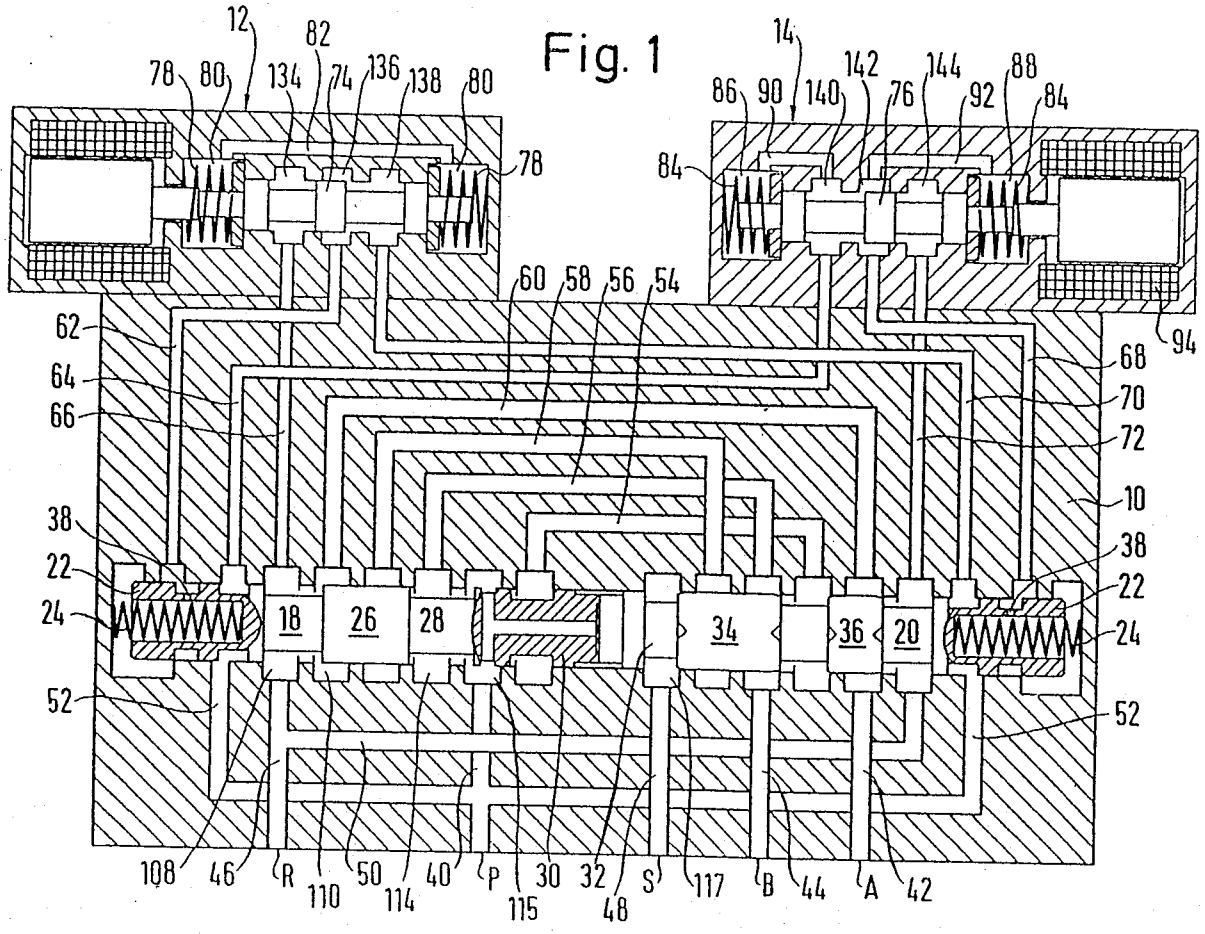
FIG. 1 is a schematic sectional view of one embodiment of a safety valve in accordance with the present invention in normal position.

Referring now to the drawing and in particular to FIG. 1, there is shown a safety valve including a housing 10, with a pilot valve 12 and a pilot valve 14 flanged thereto and with the pilot valve 14 being designed as proportional pressure differential valve.

Provided in the housing 10 is a central bore 16 which accommodates two coaxial valve bodies 18, 20 axially movable in opposite direction towards each other.

Each valve body 18, 20 is equipped with a working piston 22 having a blind end bore in which a compression spring 24 is arranged. A transverse bore 38 connects the blind end bore with a space outside the respective working piston 22. The valve body 18 is further provided with axially spaced control pistons 26, 28 and 30, and in like manner, the valve body 20 is provided with axially spaced control pistons 32, 34 and 36.

The central bore 16 is provided with annular channels 108, 110, 112, 114, 115, 116, 117, 118, 120, 122, 124, 126 which are spaced in axial direction and extend along transverse planes relative to the longitudinal axis of the central bore 16. The bore 16 is further provided with one-sided pockets 104, 106, 128, 130. The valve housing 10 has an inlet port P for connection to a pump, two working ports A and B, and two tank ports R, S. A passageway 40 connects the pump port P with the annular channel 115, a passageway 42 connects the working port A with the annular channel 124, a passageway 44 connects the working port B with the annular channel 120, a passageway 46 connects the tank port R with the annular channel 108 and a passageway 48 connects the tank port S with the annular channel 117.

Branching off channel 46 and thus of tank port R is a branch 50 which communicates with the annular channel 126. Branches 52 extend from passageway 40 and to the left and to the right from pump port P to the central bore 16 opposite the pockets 106, 128, respectively.

The annular channels 116 and 122 further communicate with each other via a passageway 54, the annular channels 114 and 120 communicate with each other via a passageway 56, the annular channels 112 and 118 communicate with each other via a passageway 58, and the annular channels 110 and 124 communicate with each other via a passageway 60.

The pilot valve 12 is provided with a piston 74 which axially moves within an axial bore of the pilot valve 12 and is retained in the normal position as shown in FIG. 1 in which the magnet of the pilot valve 12 is not excited by compression springs 80 arranged in spring chambers 78. Both spring chambers 80 are permanently connected with each other by a passageway 82. The central bore of the pilot valve 12 is provided with axially spaced annular channels 134, 136 and 138.

The pilot valve 14 is designed in form of a proportional pressure differential valve and includes a piston 76 which is axially movable in an axial bore and is retained in the normal position as shown in FIG. 1 in which the proportional magnet 94 is not excited by compression springs 84, with one compression spring 84 being arranged in a spring chamber 86 and with the other compression spring 84 being arranged in the spring chamber 88. The central bore of the pilot valve 14 is provided with axially spaced annular channels 140, 142, 144, with the annular channel 140 being permanently connected to the spring chamber 86 via a passageway 90 and with the annular channel 142 being permanently connected to the spring chamber 88 via a passageway 92.

The valve is further provided with control channels 62, 64, 66 as well as 68, 70, 72, with the control channel 62 connecting the pocket 104 with the annular channel 136 of the pilot valve 12, the control channel 64 connecting the pocket 106 with the annular channel 140 of the proportional valve 14, the control channel 66 connecting the annular channel 108 with the annular channel 134 of the pilot valve 12, the control channel 68 connecting the pocket 130 with the annular channel 142 of the proportional valve 14, the control channel 70 connecting the pocket 128 with the annular channel 138 of the pilot valve 12 and the control channel 72 connecting the annular channel 126 with the annular channel 144 of the proportional valve 14.

Figure 2:
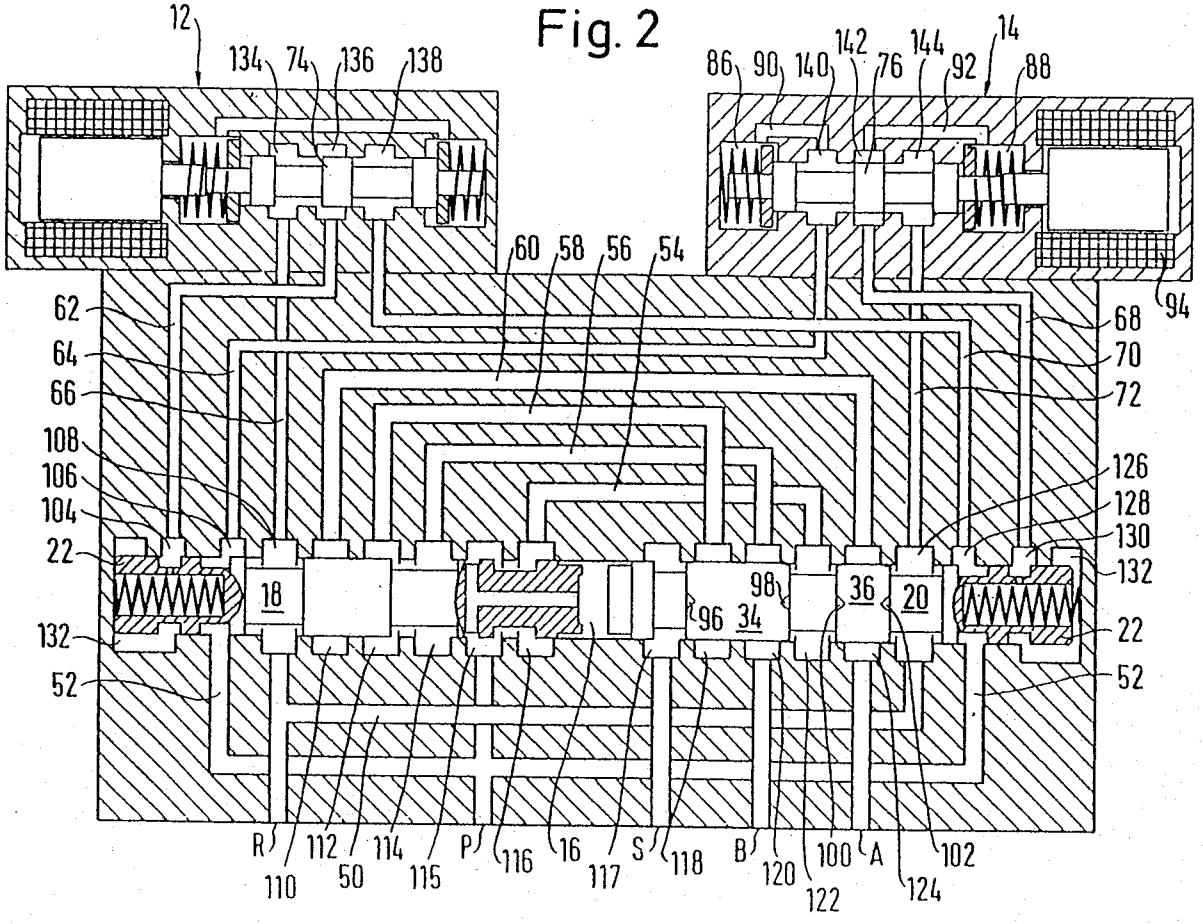
FIG. 2 is a sectional view of the safety valve in regulating position.

As is especially shown in FIG. 2, the control piston 34 is provided with fine control notches 96, 98, with fine control notch 96 controlling the connection between working port B and tank port S and with fine control notch 98 controlling the connection between the working port B and pump port P, and the control piston 36 is provided with fine control notches 100, 102, with fine control notch 100 controlling the connection between the working port A and the pump port P and with the fine control notch 102 controlling the connection between the working port A to the tank port R.

These fine control notches 96, 98; 100, 102 respectively extend from both end faces of each control piston and slightly project in axial direction into the circumference thereof.

After having described the individual elements of a safety valve in accordance with the present invention, its mode of operation will now be set forth in detail.

In the normal position according to FIG. 1, the proportional magnets 94 of both pilot valves 12, 14 are not excited. Both working pistons 22 are acted upon by pressure fluid from the pump port P, with the left working piston 22 being acted upon via the right branch 52, the control channel 70, the pilot valve 12 and the control channel 62, and with the right working piston 22 being acted upon via the left branch 52, the control channel 64, the proportional valve 14 and the control channel 68. Pressure fluid flows via the control channels 62 and 68 to and through the respective transverse bore 38 into the blind end bores of both working pistons 22 and into the spring chambers 132 to thereby inwardly load both working pistons 22. Since the supply of pressure, however, also prevails in the central bore 16 via the passageway 40 and an undesignated longitudinal bore and transverse bore in the valve body 18, these pressures compensate each other and both valve bodies 18 and 20 are urged towards each other by their compression springs 24 until their end faces abut and they occupy the normal position as shown in FIG. 1.

In this position, the pump port P is connected via the passageway 40, the annular channels 115, 114 and the passageway 56 with the passageway 44 and thus with the working port B while the working port A is connected via the passageway 42, the passageway 60 and the annular channels 110, 108 with the passageway 46 and thus with the tank port R.

Figure 3:
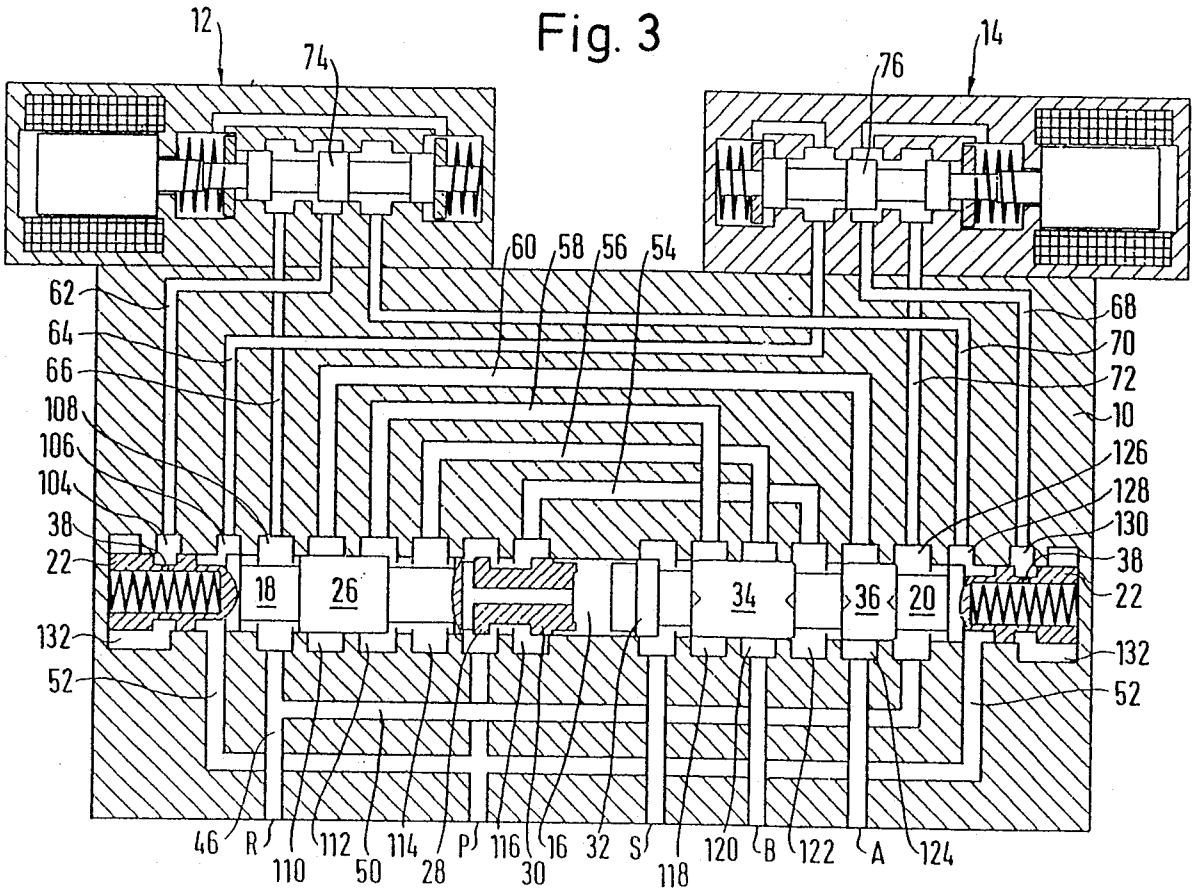
FIG. 3 is a sectional view of the safety valve illustrating the switching position thereof.

When switching over both pilot valves 12, 14, with the proportional valve 14 being fully activated so that both valves occupy the switching position as shown in FIG. 3, both working pistons 22 are pressure-relieved, with the left working piston 22 being pressure-relieved via its transverse bore 38, the pocket 104, the control channel 62, the pilot valve 12, the control channel 66, the annular channel 108 and the passageway 46 to the tank port R, and with the right working piston 22 being pressure-relieved via its transverse bore 38, the pocket 130, the control channel 68, the proportional valve 14, the control channel 72, the annular channel 126, the branch 50 and the passageway 46 to the tank port R.

Since the full pump pressure is supplied from the pump port P via the longitudinal bore and transverse bore in the valve body 18 to the central bore 16, both valve bodies 18, 20 are axially pushed apart against the force of the compression springs 24 until abutting the inside walls of the spring chambers 132 as shown in FIG. 3. In this position, the pump port P is connected via the annular channel 116, the passageway 54, as well as the annular channels 122, 124 with the working port A while the working port B communicates via the annular channel 120, the passageway 56, the annular channels 114, 112, the passageway 58 and the annular channels 118, 117 with the tank port S.

Figure 4:
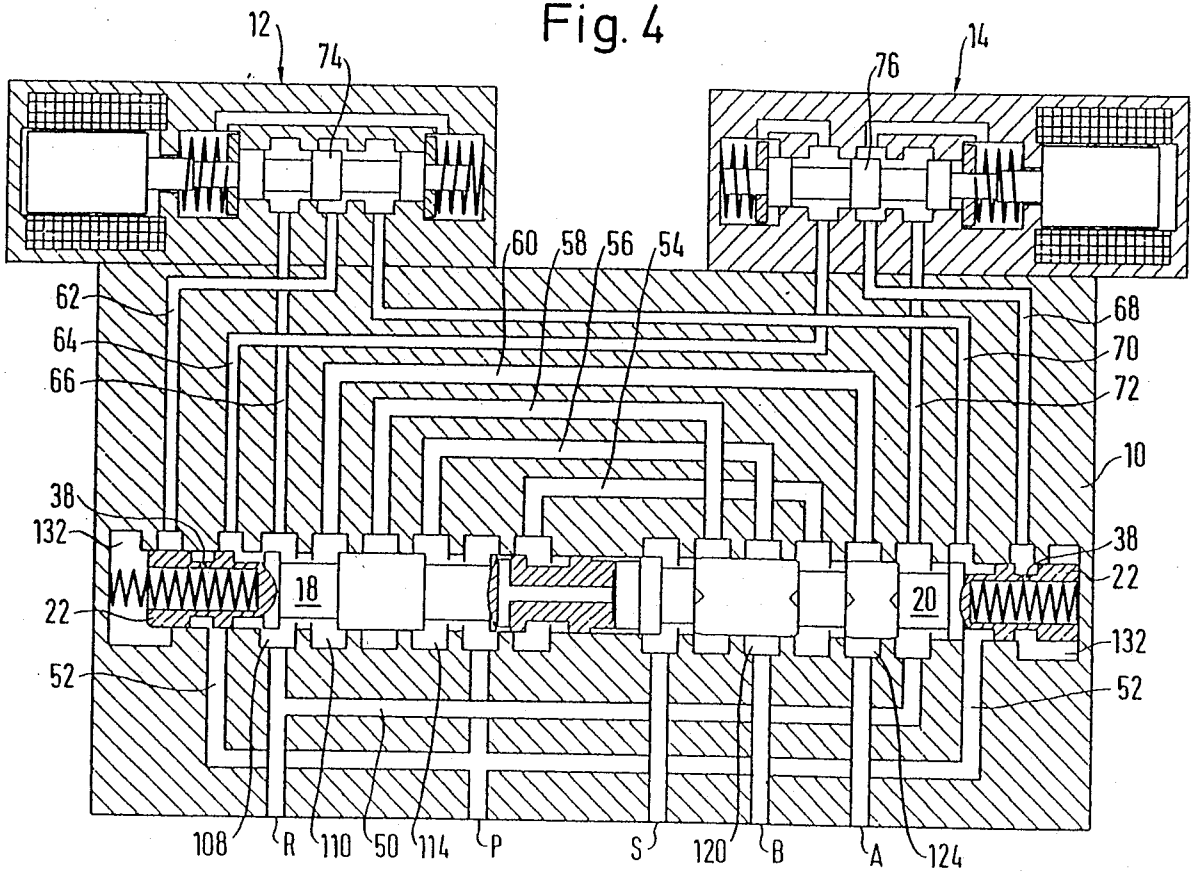
FIGS. 4 and 5 are each a schematic sectional view of the safety valve upon occurrence of a faulty switching.
Figure 5:
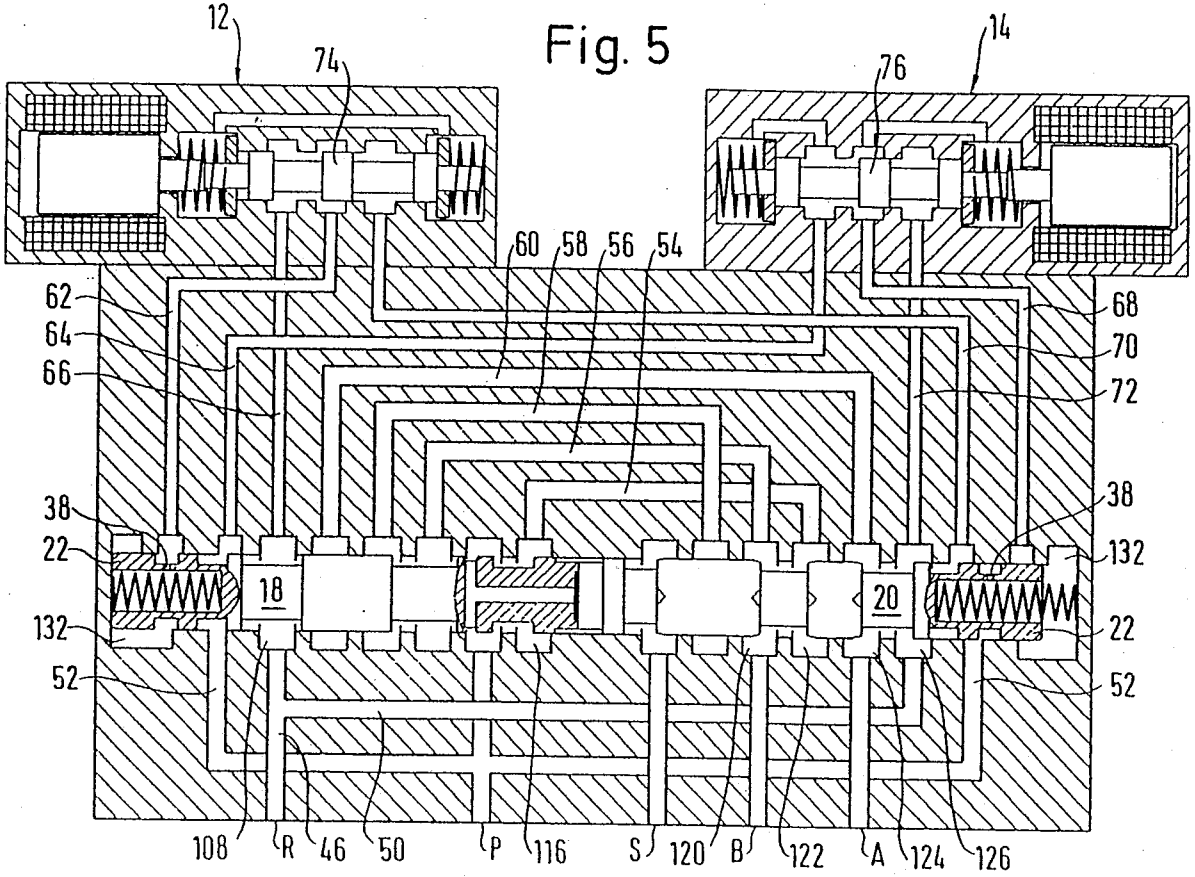

Turning now to FIGS. 4 and 5 which show the safety valve upon occurrence of a faulty switching, with FIG. 4 illustrating the situation in which the pilot valve 12 gets caught in the normal position while the proportional valve 14 has been switched, and with FIG. 5 illustrating the situation in which the pilot valve 12 has been switched while the proportional valve 14 has not been switched.

In FIG. 4, the spring chamber 132 of the left working piston 22 is acted upon by the full pump pressure from pump port P via the left branch 52, an annular groove in the outer circumference of the left working piston 22 as well as via its transverse bore 38 through which the pressure fluid flows into the blind end bore and into the spring chamber 132. The right working piston 22 is connected via the control channel 68, the proportional valve 14 and the control channel 72 as well as via the branch 50 with the tank port R and thus pressure-relieved. Both valve bodies 18 and 20 move to the right until the right working piston 22 is stopped by abutting the facing inside wall of the spring chamber 132. In this position, the pump port P is connected with the working port B while the working port A communicates with the tank port R. Even a subsequent switching over of the pilot valve 12 will not alter this position because although the control channel 62 would then become pressure-relieved via the pilot valve 12 and the control channel 66, the spring chamber 132 of the left working piston 22 still remains connected via the left branch 52 to pump port P. Moreover, the right spring chamber 132 cannot be acted upon by pressure through switching over the proportional valve 14 because the pressure connection of proportional valve 14 via the passageway 64, the pocket 106, the annular channel 108 and passageway 46 is maintained with the tank port R.

In FIG. 5, these conditions are exactly reversed i.e. the spring chamber 132 of the right working piston 22 is acted upon by the pump pressure via the right branch 52, an annular groove at the outer circumference of the right working piston 22 and via its transverse bore 38 through which the pressure fluid flows into the blind end bore of the right working piston 22 and into the spring chamber 132. The left spring chamber 132 and thus the left working piston 22 is, however, connected via its transverse bore 38, the control channel 62, the pilot valve 12 and the control channel 66 as well as via the annular channel 108 with the passageway 46 and thus with the tank port R. Therefore, both valve bodies 18 and 20 move towards the left until the left working piston 22 is stopped by abutting the facing inside wall of the spring chamber 132 as shown in FIG. 5. In this case, too, the pump port P is connected with the working port B while the working port A communicates with tank port R and thus is pressure-relieved.

A subsequent switching over of the proportional valve 14 would remain ineffective since the right working piston 22 is still acted upon by the pump pressure via the right branch 52 as described with reference to FIG. 4.

The valve thus remains hydraulically locked at each faulty switching and may be operated and returned into the normal position only after eliminating the malfunction by pressure relief at pump port P.

FIG. 2 shows the regulating position of the valve. The pilot valve 12 occupies the switching position while the proportional valve 14 is actuated in such a manner that its piston 76 is in zero-position in which the connection between pump port P and working port B has just closed while the connection between pump port P and working port A has not yet opened.

When increasing the control current of the proportional magnet 94, the piston 76 is slightly shifted to the left in FIG. 2 so that the connection between the control channel 64, which communicates via annular channel 106 and branch 52 with the pump port P, and the control channel 68, which communicates with the right spring chamber 132 via the annular channel 130 and the transverse bore 38, is slightly throttled while the connection between control channel 68 and the control channel 72, which communicates via the annular channel 126 and branch 50 with the tank port R, is slightly further opened. The pressure in the right spring chamber 132 is thus reduced so that the valve body 20 is slightly moved to the right against the force of the compression spring of the right working piston 22 and against the pressure in the right spring chamber 132 since the full pump pressure prevails in the central bore 16.

Thus, the connection between pump port P and working port A is opened via the annular channels 115, 116, the passageway 54, the annular channel 122 and the fine control notches 100 via which oil enters the annular channel 124 and eventually the working port A. At the same time, the connection between working port B and tank port S is opened via the annular channel 120, the passageway 56, the annular channels 114, 112, the passageway 58, the annular channels 118, the fine control notches 98 and annular channel 117 which communicates with the tank port S. Likewise, the connection between working port A and tank port R and the connection between working port B and pump port P is closed.

When, however, reducing the control current of the proportional magnet 94 in comparison to the position as shown in FIG. 2, the connection between control channel 64 and control channel 68 is less throttled and the connection between the control channel 68 and control channel 72 is further closed to thereby increase the pressure in the spring chamber 132 of the right working piston 22 so that the valve body 20 is slightly shifted to the left from the position as shown in FIG. 2. In this position, the pump port P is connected via the passageway 54, the annular channel 122 and the fine control notches 98 with the working port B while the working port A is connected via the annular channel 124, the fine control notches 102, the annular channel 126 and the branch 50 with the tank port R. Likewise, the connection between working port A and the pump port P and the connection between working port B and tank port S is closed.

In case the control current of the proportional magnet 94 is zero, its piston occupies the position as shown in FIG. 5 in which the pressure in the right spring chamber 132 corresponds to the pump pressure. Both valve bodies 18 and 20 move to the left into the hydraulically locked faulty switching as shown in FIG. 5.

Through the provision of the proportional pressure differential valve and the fine control notches, the safety valve can be proportionally regulated so as to allow a control of the pressure buildup, the speed and direction of motion of the consumer which is connected to the safety valve.

While the invention has been illustrated and described as embodied in a safety valve, it is not intended to be limited to the details shown since various modifications and structural changes may be made without departing in any way from the spirit of the present invention.

What is claimed as new and desired to be protected by Letters Patent is set forth in the appended claims:

1. A safety valve assembly, comprising:

a valve housing defining a bore and having a fluid inlet port, two tank ports and two working ports adapted for connection to a fluid operated system to allow alternate supply of a pressure fluid to the latter;

valve means including two valve bodies movable in opposite direction towards each other in said bore of said housing, each of said valve bodies including a working piston and control pistons connected to said working piston for regulating the flow of a pressure fluid between said fluid inlet port, said tank ports and said working ports; and actuating means for displacing said valve bodies in said bore of said housing and including one pilot valve designed as a proportional pressure differential valve, said control pistons of said working piston which are operatively connected with said proportional pressure differential valve being provided with fine control notches.

2. A safety valve assembly as defined in claim 1 wherein said proportional pressure differential valve includes a piston and has a first port connectable with said fluid inlet port and a second port connectable with one of said working ports, said piston controlling said first port and said second port in such a manner that the connection therebetween and thus between said fluid inlet port and said one working port is throttleable.

3. A safety valve assembly as defined in claim 2 wherein said proportional pressure differential valve includes a spring chamber at opposing ends thereof and spring means accommodated in said spring chambers for keeping said piston in a central position.

4. A safety valve assembly as defined in claim 3 wherein said proportional pressure differential valve includes a passageway connecting one of said spring chambers with said first port and another passageway connecting the other one of said spring chambers with said second port.

5. A safety valve assembly as defined in claim 1 wherein said control pistons of said working piston which are operatively connected to said proportional pressure differential valve has opposing end faces and is provided with at least one fine control notch extending from each of its end faces.

6. A safety valve assembly as defined in claim 1 wherein said working piston includes two axially spaced control pistons, each of which including a fine control notch at each end face thereof, one of said fine control notches of one of said control pistons controlling the connection between one of said working ports with one of said tank ports and the other one of said fine control notches controlling the connection between said one working port to said fluid inlet port, and one of said fine control notches of the other one of said control pistons controlling the connection between the other one of said working ports with said fluid inlet port and the other one of said fine control notches of said other control piston controlling the connection between said other working port and said other one of said tank ports.

7. A safety valve assembly as defined in claim 1 wherein said actuating means includes two pilot valves mounted to said housing.

* * * * *